US007191631B2

(12) United States Patent
Break

(10) Patent No.: US 7,191,631 B2
(45) Date of Patent: Mar. 20, 2007

(54) SHEET METAL BENDING BRAKE WITH IMPROVED HINGE

(75) Inventor: Douglas Break, Livonia, MI (US)

(73) Assignee: Tapco International Corporation, Wixom, MI (US)

( * ) Notice: Subject to any disclaimer, the term of this patent is extended or adjusted under 35 U.S.C. 154(b) by 0 days.

(21) Appl. No.: 10/984,124

(22) Filed: Nov. 9, 2004

(65) Prior Publication Data

US 2005/0103081 A1 May 19, 2005

Related U.S. Application Data

(60) Provisional application No. 60/532,281, filed on Dec. 23, 2003, provisional application No. 60/520,472, filed on Nov. 14, 2003.

(51) Int. Cl.
*B21D 5/04* (2006.01)

(52) U.S. Cl. ..... 72/319; 72/466.8

(58) Field of Classification Search ..... 72/319–321, 72/465.1, 466, 466.8, 54
See application file for complete search history.

(56) References Cited

U.S. PATENT DOCUMENTS 502,684 A * 8/1893 Story ..... 72/319
2,396,996 A * 3/1946 Frost et al. ..... 425/394
4,081,986 A 4/1978 Break ..... 72/320
4,282,735 A * 8/1981 Break ..... 72/319
4,557,132 A 12/1985 Break ..... 72/319
4,566,304 A 1/1986 Van Cleave et al. ..... 72/319
4,671,094 A 6/1987 Break ..... 72/319
4,766,757 A 8/1988 Break et al. ..... 72/319
5,505,069 A 4/1996 Break et al. ..... 72/319
5,644,940 A 7/1997 Chubb et al. ..... 72/197
6,167,737 B1 * 1/2001 Lyons et al. ..... 72/133
6,532,789 B1 3/2003 Chubb et al. ..... 72/319
6,748,784 B1 6/2004 Chubb et al. ..... 72/319
6,865,917 B2 * 3/2005 Golovashchenko et al. .... 72/57

* cited by examiner

*Primary Examiner*—Daniel C. Crane
(74) *Attorney, Agent, or Firm*—Howard & Howard Attorneys, P.C.

(57) ABSTRACT

A sheet metal bending brake having a frame with a sheet metal support surface. A clamping jaw is movable relative to the frame support surface to clamp the sheet metal between the clamping jaw and the frame. The clamping jaw has a linear front edge. An elongated bending arm is pivotally mounted to the frame by an elongated flexible strap having spaced apart edges. One edge of the strap is secured to the bending arm while the other edge of the strap is secured to the frame such that the bending arm extends parallel to and closely adjacent the clamping jaw front edge.

14 Claims, 4 Drawing Sheets

SHEET METAL BENDING BRAKE WITH IMPROVED HINGE

RELATED APPLICATIONS

This application claims priority of U.S. Provisional Patent Applications Ser. No. 60/520,472 filed Nov. 14, 2003 and Ser. No. 60/532,281 filed Dec. 23, 2003, which are incorporated herein by reference.

BACKGROUND OF THE INVENTION

I. Field of the Invention

The present invention relates generally to sheet metal bending brakes and, more particularly, to a sheet metal bending brake with an improved hinge.

II. Description of Related Art

There are many previously known portable sheet metal bending brakes that are used in the building industry, typically for the installation of aluminum siding. These previously known sheet metal bending brakes typically comprise a frame having a planar work support surface which supports the sheet metal as well as a plurality of spaced frame members which extend over the work support surface.

A plurality of elongated pivot arms are pivotally secured at one end to the spaced apart frame members. An elongated clamping jaw is then mounted to the opposite end of each pivot arm such that upon pivoting of the pivot arms, the clamping jaw moves toward and away from the work support surface on the frame.

Any conventional means can be used to move the pivot arms with their attached clamping jaw between their clamping and unclamped position. In their unclamped position, the clamping jaw is spaced apart from the sheet metal support surface thus permitting the insertion and/or removal of sheet metal into the bending brake. Conversely, when the pivot arms are moved to their clamping position, the sheet metal is sandwiched in between the clamping jaw and the work support surface on the frame. Any conventional means may be used to move the clamping jaw between its clamping and unclamped positions.

An elongated bending arm is pivotally mounted to the frame such that the bending arm extends along the front edge of the workpiece support surface on the frame closely adjacent the front edge of the clamping jaw when in its clamped position. Consequently, with a piece of sheet metal positioned in between the frame and the clamping jaw such that a portion of the sheet metal protrudes outwardly from the front edge of the clamping jaw, pivotal movement of the bending arm in turn engages the outwardly protruding portion of the sheet metal and bends that outwardly protruding portion in the desired fashion.

There have been many previously known devices for pivotally mounting the bending arm to the frame. All of these previously known pivoting mechanisms, however, all suffer from one or more common problems.

More specifically, many of the previously known hinge mechanisms for pivotally securing the bending arm to the frame scuffed the surface of the sheet metal during the bending operation. In many situations, such scuffing is cosmetically unacceptable.

Similarly, many of the previously known hinge mechanisms for sheet metal bending brakes are incapable of bending the sheet metal when only a very small amount of sheet metal protrudes outwardly from the clamping jaw. For example, many previously known bending brakes are incapable of forming a bend in sheet metal of less than 3/16 of an inch in width. Similarly, many of the previously known hinge mechanisms for sheet metal bending brakes are incapable of producing hems of very small widths.

SUMMARY OF THE PRESENT INVENTION

The present invention provides a portable sheet metal bending brake which overcomes all of the above-mentioned disadvantages of the previously known devices.

In brief, the sheet metal bending brake of the present invention comprises a frame having a sheet metal support surface extending longitudinally along the frame. A clamping jaw is movably mounted to the frame such that the clamping jaw is movable between a clamped position relative to the sheet metal support surface and an unclamped position. In its clamped position, the clamping jaw sandwiches a piece of sheet metal in between the clamping jaw and the sheet metal support surface on the frame. Conversely, in its unclamped position, the clamping jaw is spaced away from the sheet metal support surface to enable sheet metal to be positioned into or removed from the bending brake. Any conventional means may be used to move the clamping jaw between its clamped and unclamped position.

An elongated bending arm is pivotally mounted to the frame such that the arm extends longitudinally along the sheet metal frame adjacent the front edge of the sheet metal support surface. In order to pivotally secure the bending arm to the frame, an elongated flexible strap having spaced-apart edges is provided. One edge of the flexible strap is secured to the frame while an intermediate point of the flexible strap is secured to the bending arm such that the connection between the flexible strap and the bending arm is closely adjacent to and parallel to the front edge of the clamping jaw when the clamping jaw is in its clamped position.

Preferably the frame includes a semi-cylindrical bearing surface which extends parallel to and is spaced outwardly from the front edge of the jaw when the jaw is in its clamped position. The bending arm in turn includes a semi-cylindrical bearing surface which nests within the frame bearing surface to provide support for the bending arm both during and after a bending operation. A bearing sleeve is also preferably sandwiched in between the bearing surfaces on the bending arm and frame.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
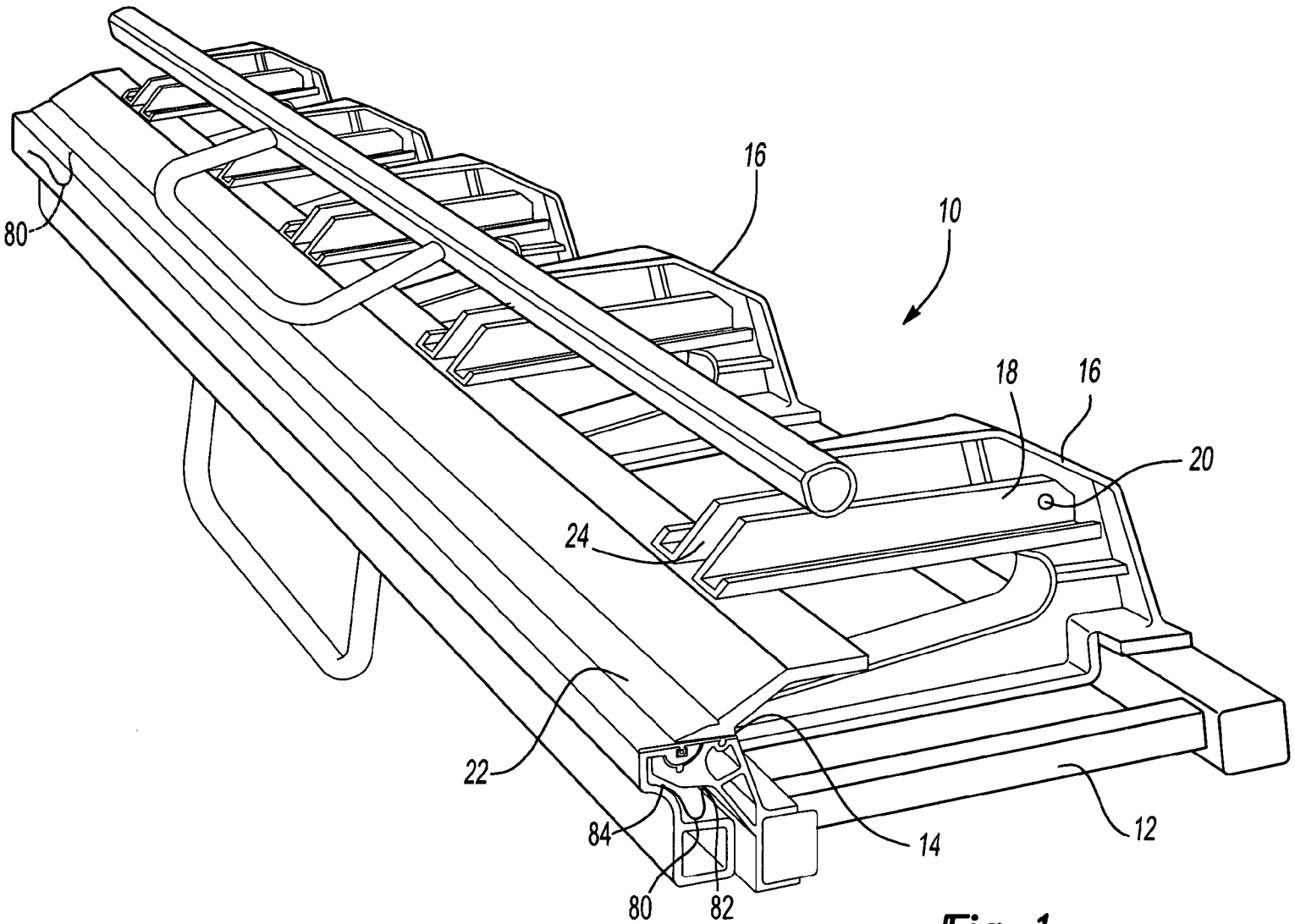
FIG. 1 is an elevational view illustrating a preferred embodiment of the present invention.

With reference first to FIG. 1, a preferred embodiment of the portable sheet metal bending brake 10 of the present invention is shown and includes a stationary frame 12 which is constructed of any rigid material, such as metal. The frame 12 is supported in any conventional fashion, such as by a stand (not shown). Additionally, the frame 12 includes an elongated sheet metal support surface 14 which is adapted to receive and support a piece of sheet metal within the bending brake 10.

A plurality of rigid frame members 16 are secured to the frame 12 such that the frame members 16 are longitudinally spaced from each other along the frame 12. The frame members 16 are secured to the frame 12 such that the frame members 16 are spaced upwardly from the sheet metal support surface 14.

A pivot arm 18 is pivotally secured at one end 20 to each frame member 16 so that the pivot arms 18 are also longitudinally spaced apart from each other along the frame 12. An elongated clamping jaw 22 is secured to the front or opposite end 24 of each pivot arm 18 so that the clamping jaw 22 extends longitudinally along the frame 12 above the sheet metal support surface 14.

Figure 2:
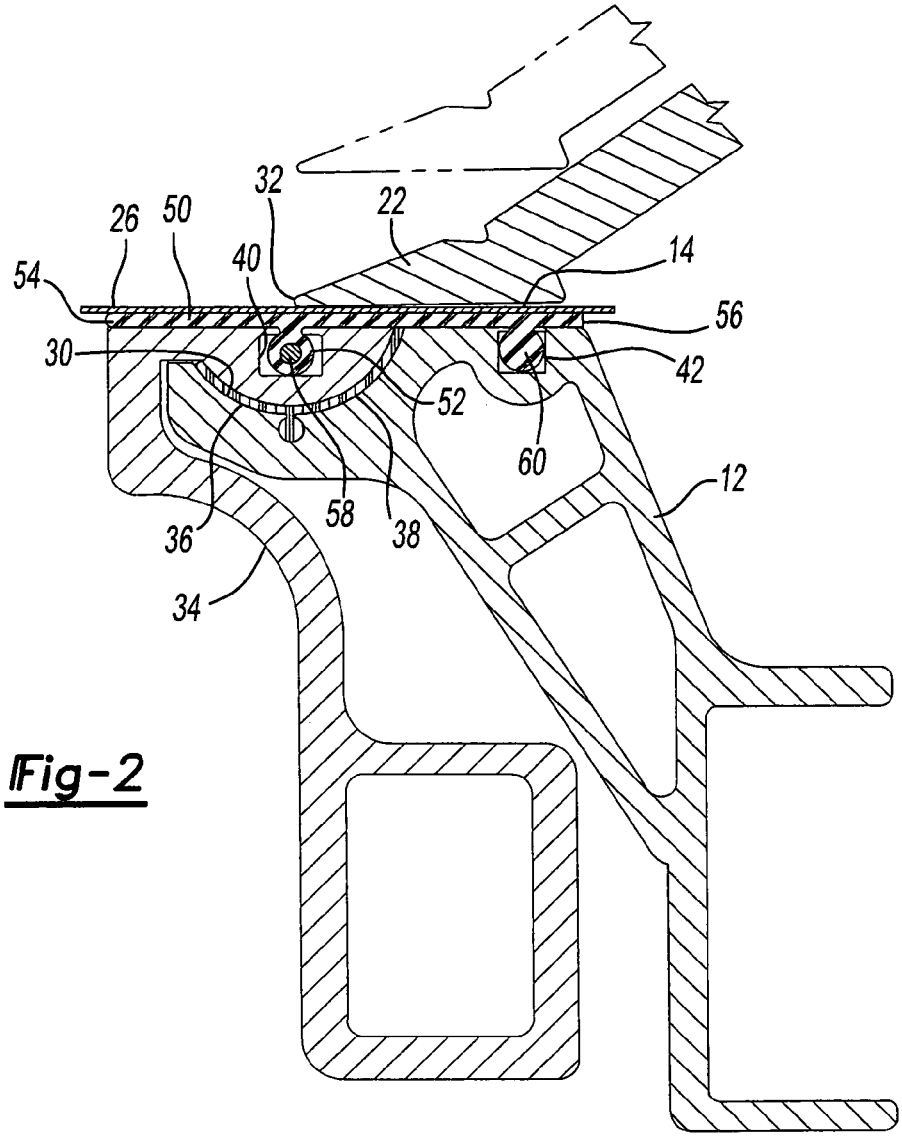
FIG. 2 is a fragmentary sectional view illustrating a portion of the preferred embodiment of the present invention.

With reference now to FIGS. 1 and 2, the clamping jaw 22 is movable between a clamped position, illustrated in solid line in FIG. 2, and an unclamped position, illustrated in phantom line in FIG. 2. In its unclamped position (phantom line in FIG. 2), the clamping jaw 22 is spaced apart from the sheet metal support surface 14 to enable the insertion or removal of a piece 26 of sheet metal into the sheet metal bending brake 10. Conversely, in its clamped position (solid line in FIG. 2), the piece 26 of sheet metal is sandwiched in between the clamping jaw 22 and the sheet metal support surface 14 on the frame 12.

With reference now particularly to FIG. 2, the frame 12 includes a semi-cylindrical bearing surface 30 which extends longitudinally along the frame 12 and so that the bearing surface 30 is substantially aligned with a front edge 32 of the clamping jaw 22. Preferably, the cylindrical bearing surface 30 and the frame 12 are of a one-piece construction and thus rigid with respect to each other.

An elongated bending arm 34 also includes a semi-cylindrical bearing surface 36 which is complementary in shape to the bearing surface 30 on the frame 12. The bending arm 34 is mounted to the frame 12 so that the bending arm bearing surface 36 is nested within and supported by the bearing surface 30 on the frame 12. Additionally, a bearing sleeve 38 is sandwiched in between the bearing surfaces 30 and 36 to minimize friction between the bending arm 34 and frame 12. The bearing sleeve 38 may be of any conventional construction, such as a high molecular weight synthetic material and/or a fluoropolymer.

Still referring to FIG. 2, a T slot or rectangular channel 40 is formed in the bending arm 34 and the channel 30 is aligned with the front edge 32 of the clamping jaw 22. Similarly, a T slot or channel 42 is also formed in the frame 12 such that the channels 40 and 42 are spaced apart and generally parallel to each other.

Figure 3:
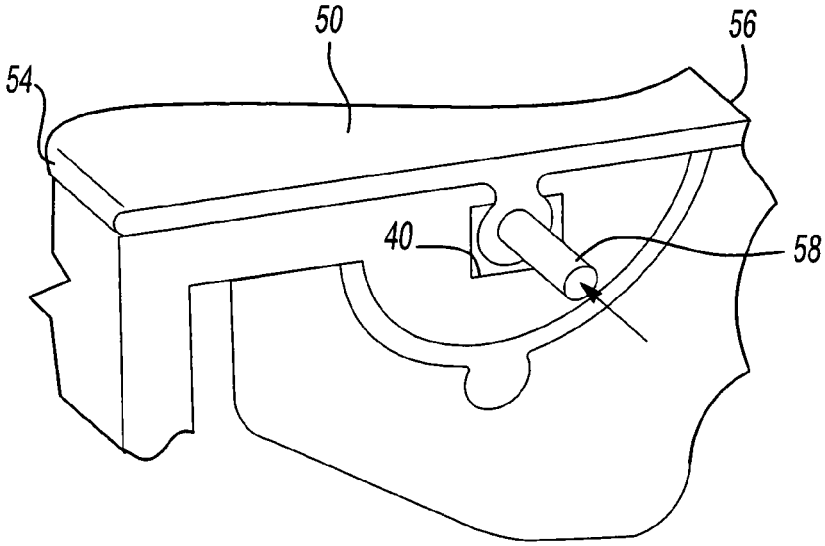
FIG. 3 is a fragmentary view illustrating a portion of the preferred embodiment of the present invention.

An elongated flexible strap 50, preferably constructed of polyurethane, pivotally secures the bending arm 34 to the frame 12. As best shown in FIG. 2, the flexible strap 50 includes a first longitudinally extending protrusion 52 at an intermediate point between the sides 54 and 56 of the flexible strap 50. This protrusion 52 is positioned within the channel 40 formed on the bending brake 34. In order to ensure a locking engagement between the flexible strap 50 and the bending brake 34, a metal pin 58, best shown in FIGS. 2 and 3, is inserted into a longitudinal bore formed in the protrusion 52 after insertion of the protrusion 52 into the channel 40.

The flexible strap 50 also preferably includes a second elongated protrusion 60 which extends longitudinally along the strap 50 adjacent its rear edge 56. This protrusion 60 is lockingly positioned within the channel 42 formed on the frame 12.

Figure 4:
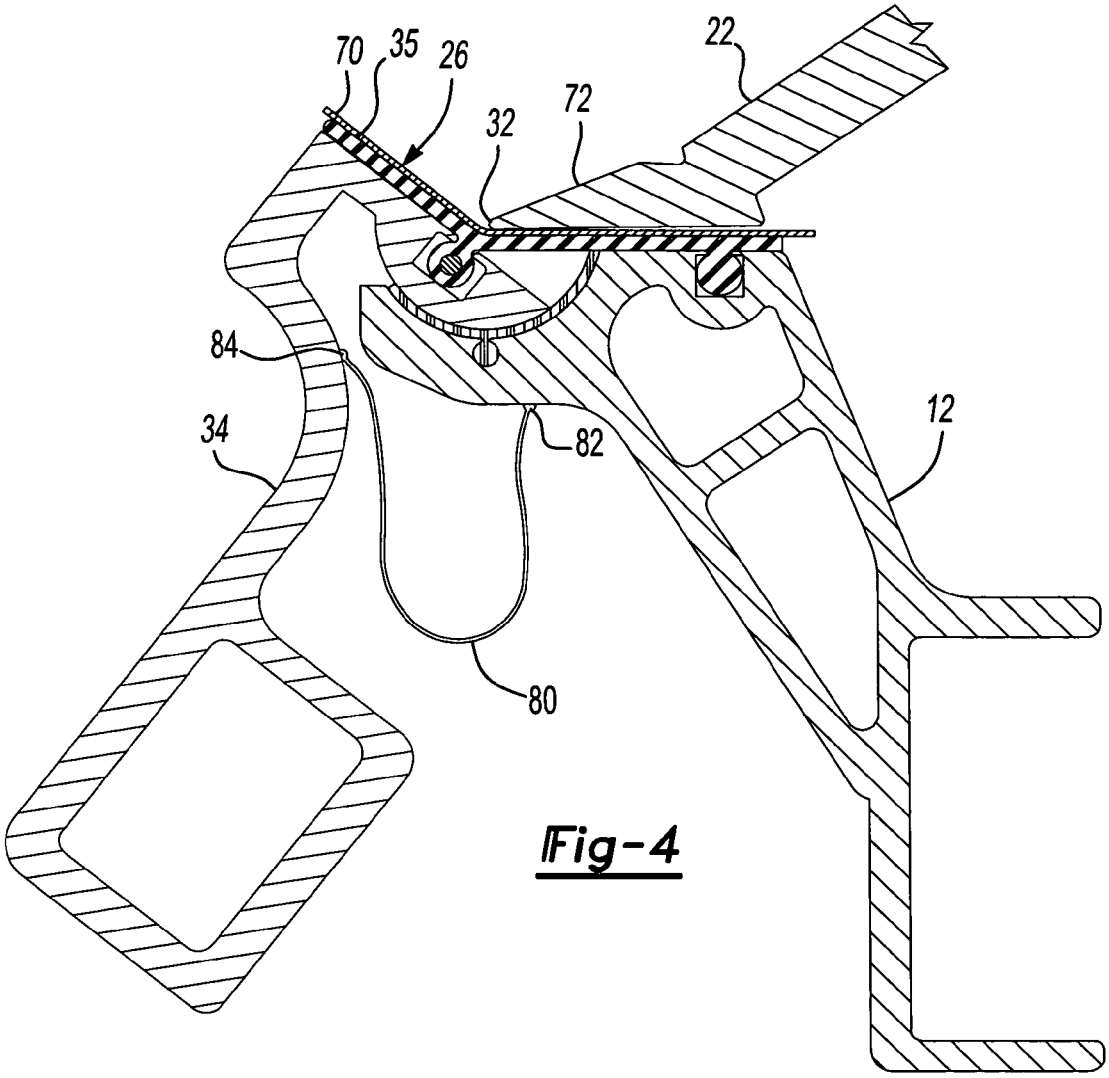
FIG. 4 is a view similar to FIG. 2, but illustrating the operation of the sheet metal bending brake of the present invention.

With reference now to FIG. 4, the operation of the bending brake 10 will now be described. First, the piece 26 of sheet metal is positioned in between the clamping jaw 22 and the frame 12 so that, when the clamping jaw 22 is moved to its clamped position, the piece 26 of sheet metal is rigidly held to the frame 12 and so that a portion 70 of the sheet metal to be bent protrudes outwardly from the front edge 32 of the clamping jaw 22. Thereafter, the bending arm 34 is pivoted from the position shown in FIG. 2 and toward the position shown in FIG. 4. In doing so, the bearing surfaces 30 and 36 on the frame 12 and bending arm 34 pivot relative to each other. As the bending arm 34 is pivoted, the portion 35 of the bending arm 34 beneath the protruding portion 70 of the sheet metal piece 26 bends the sheet metal 70 about the outer edge 32 of the clamping arm 22. It will be understood, of course, that the degree of bending of the sheet metal portion 70 shown in FIG. 4 is by way of example only and that sheet metal bends of different angles are formed by merely pivoting the bending arm 34 to the desired angle relative to the frame 12.

Figure 5:
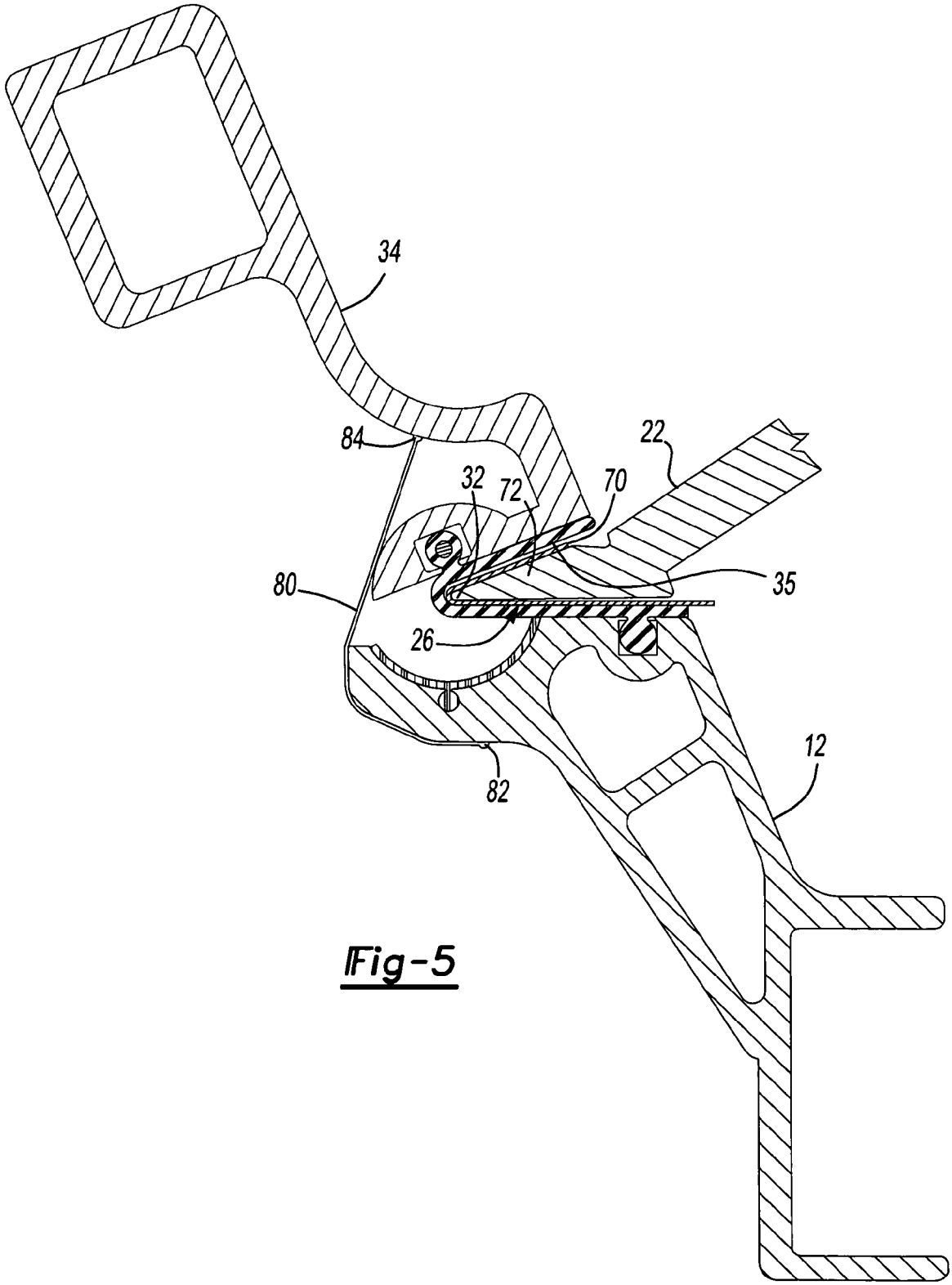
FIG. 5 is a view similar to FIG. 4 but illustrating the sheet metal bending brake in a full bend position.

With reference now to FIGS. 1 and 5, at least one, and preferably two or more spaced non-elastic cables 80 each have one end 82 secured to the frame 12 and their other end 84 secured to the bending arm 34. The cables 80 each have a length such that, during a full bend operation as illustrated in FIG. 5 in which the bending arm 34 sandwiches the sheet metal between the bending arm 34 and the clamping jaw 22, the cables 80 become taut and abut against both the bending arm 34 and the frame 12 to limit the rotation of the bending arm 34 to the full bend position shown in FIG. 5. In practice the cables 80, by limiting the pivotal position of the bending arm 34 relative to the frame 12, prevent stretching of the flexible strap 50. Furthermore, the cables 80 may alternatively be in the form of a non-elastic flat strap.

In practice, the provision of the flexible strap 50 for pivotally securing the bending arm 34 to the frame 12 not only prevents scuffing of the sheet metal during the bending operation but also enables very narrow outwardly protruding portions 70 of the sheet metal to be bent due to the continuous contact between the flexible strap 50 and the sheet metal.

Additionally, the sheet metal bending brake can also be used to perform hems. In order to perform a hem, the outwardly protruding portion 26 of the sheet metal is bent against the top of the clamping jaw 22. The clamping jaw 22 is then moved to its unclamped position and the bent sheet metal removed from the sheet metal bending brake. Thereafter, the bent portion of the sheet metal is positioned on a top surface 72 (FIG. 4) of the clamping jaw 22 and the bending arm 34 pivoted against the top surface 72 of the clamping jaw 22 to finalize the hem.

From the foregoing, it can be seen that the present invention provides a simple and yet highly effective portable sheet metal bending brake with an improved hinge for the bending arm. Having described my invention, however, many modifications thereto will become apparent to those skilled in the art to which it pertains without deviation from the spirit of the invention as defined by the scope of the appended claims.

I claim:

1. A sheet metal bending brake comprising:

a frame having an elongated sheet metal support surface, a clamping jaw movable relative to said frame support surface to clamp the sheet metal between the clamping jaw and the frame, said jaw having a linear elongated front edge, an elongated bending arm, an elongated flexible strap having spaced apart edges, a longitudinally extending intermediate portion of said strap being secured to said bending arm and a longitudinally extending outer edge portion of said strap being secured to said frame so that said bending arm extends parallel to and closely adjacent said front edge of said clamping jaw, said longitudinally extending outer edge portion and longitudinally extending portion of said strap being substantially parallel to said elongated front edge of said jaw, whereby said strap pivotally mounts said bending arm to said frame about a first axis parallel to said jaw edge.

2. The invention as defined in claim 1 wherein said strap is made of polyurethane.

3. The invention as defined in claim 1 wherein said strap includes an elongated protrusion which extends longitudinally along said strap at a position intermediate said spaced apart edges, said protrusion being positioned in a channel formed in said bending arm.

4. The invention as defined in claim 3 wherein said protrusion is arcuate in cross-sectional shape.

5. The invention as defined in claim 4 wherein said bending arm channel is rectangular in cross-sectional shape.

6. The invention as defined in claim $ and comprising an elongated pin inserted longitudinally into said protrusion such that said pin is positioned within said bending arm channel.

7. The invention as defined in claim 3 and comprising a second elongated protrusion which extends longitudinally along said strap adjacent one side of said swap, said second protrusion being positioned in a channel formed in said frame.

8. The invention as defined in claim 1 wherein said frame includes a semi-cylindrical bearing surface extending parallel to and spaced outwardly from said jaw front edge, and wherein said bending arm includes a semi-cylindrical bearing surface which nests in said frame bearing surface.

9. The invention as defined in claim 8 and comprising a bearing sleeve sandwiched between said bending arm bearing surface and said frame bearing surface.

10. The invention as defined in claim 9 wherein said bearing sleeve is constructed of a high molecular weight synthetic material.

11. The invention as defined in claim 9 wherein said bearing sleeve is constructed of a fluoropolymer material.

12. The invention as defined in claim 1 wherein said intermediate portion of said strap is aligned with said front edge of said clamping jaw.

13. The invention as defined in claim 1 and further comprising at least one non-elastic elongated cable having one end secured to said frame and the other end secured to said bending arm, said at least one cable being dimensioned to limit the pivotal position of said bending arm relative to said frame to a predetermined pivotal position.

14. The invention as defined in claim 13 wherein said at least one cable comprises at least two spaced apart cables.

* * * * *

UNITED STATES PATENT AND TRADEMARK OFFICE

CERTIFICATE OF CORRECTION

PATENT NO. : 7,191,631 B2
APPLICATION NO. : 10/984124
DATED : March 20, 2007
INVENTOR(S) : Douglas Break It is certified that error appears in the above-identified patent and that said Letters Patent is hereby corrected as shown below:

Column 5, Line 35, Claim 6, please delete "$" and insert therein --5--.

Column 6, Line 3, Claim 7, please delete "swap" and insert therein --strap--.

Signed and Sealed this

Fifteenth Day of May, 2007

JON W. DUDAS
*Director of the United States Patent and Trademark Office*